US009242831B2

(12) United States Patent
Ishikawa et al.

(10) Patent No.: US 9,242,831 B2
(45) Date of Patent: Jan. 26, 2016

(54) PRINTER

(71) Applicant: FUJITSU COMPONENT LIMITED, Tokyo (JP)

(72) Inventors: Tetsuhiro Ishikawa, Tokyo (JP); Sumio Watanabe, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 218 days.

(21) Appl. No.: 13/948,228

(22) Filed: Jul. 23, 2013

(65) Prior Publication Data

US 2014/0027559 A1 Jan. 30, 2014

(30) Foreign Application Priority Data

Jul. 24, 2012 (JP) ..... 2012-164042

(51) Int. Cl.
*B65H 75/24* (2006.01)
*B41J 15/02* (2006.01)

(52) U.S. Cl.
CPC ..... *B65H 75/242* (2013.01); *B41J 15/02* (2013.01); *B65H 2301/41346* (2013.01)

(58) Field of Classification Search
CPC ..... B65H 75/24; B65H 75/242; B65H 2301/41346
USPC ..... 242/571.3–571.6, 597, 597.8
See application file for complete search history.

(56) References Cited

U.S. PATENT DOCUMENTS

| | | | | |
|---|---|---|---|---|
| 5,725,321 | A * | 3/1998 | Brannan et al. | 400/708 |
| 5,904,329 | A | 5/1999 | Kanome et al. | |
| 6,106,175 | A * | 8/2000 | Narita et al. | 400/611 |
| 6,814,515 | B2 | 11/2004 | Tsuchiya et al. | |
| 7,100,859 | B2 | 9/2006 | Kayanuma et al. | |
| 7,823,825 | B2 * | 11/2010 | Genta et al. | 242/573 |
| 8,568,046 | B2 * | 10/2013 | Campbell et al. | 400/613 |

FOREIGN PATENT DOCUMENTS

| | | |
|---|---|---|
| JP | H03-074544 U | 7/1991 |
| JP | 08-217295 | 8/1996 |
| JP | 2000-238946 | 9/2000 |
| JP | 2003-019845 | 1/2003 |
| JP | 2003-246508 | 9/2003 |
| JP | 2004-292158 | 10/2004 |

* cited by examiner

*Primary Examiner* — Sang Kim
(74) *Attorney, Agent, or Firm* — IPUSA, PLLC

(57) ABSTRACT

A printer includes an arm part connected to a printer body part and a paper roll support shaft part having a first end connected to the arm part and a second end to be inserted into a hollow core of a paper roll. The paper roll support shaft includes a first support shaft and a second support shaft. The paper roll support shaft is configured to come into contact with the interior of the core at a first contact point on the first support shaft and a second contact point on the second support shaft.

6 Claims, 17 Drawing Sheets

PRINTER

CROSS-REFERENCE TO RELATED APPLICATION

The present application is based upon and claims the benefit of priority of Japanese Patent Application No. 2012-164042, filed on Jul. 24, 2012, the entire contents of which are incorporated herein by reference.

BACKGROUND OF THE INVENTION

1. Field of the Invention

The present invention relates to printers.

2. Description of the Related Art

Printers that output paper slips such as receipts are used for a wide variety of purposes, such as for registers in shops and automated teller machines (ATMs) or cash dispensers (CDs) in banks. In such printers that output receipts or the like, printing is usually performed on predetermined positions on thermal paper, serving as recording paper, using a thermal head or the like while conveying the thermal paper.

In such printers that perform printing on recording paper using a thermal head, printing is performed with the recording paper positioned between the thermal head and a platen roller. The recording paper, on which printing is performed, is wound in a roll around a hollow core, and is fed toward the thermal head side while being supported by a paper roll support shaft.

For related art, reference may be made to Japanese Laid-Open Patent Application No. 2003-19845, Japanese Laid-Open Patent Application No. 8-217295, Japanese Laid-Open Patent Application No. 2004-292158, and Japanese Laid-Open Patent Application No. 2003-246508.

SUMMARY OF THE INVENTION

According to an aspect of the present invention, a printer includes an arm part connected to a printer body part and a paper roll support shaft part having a first end connected to the arm part and a second end to be inserted into a hollow core of a paper roll. The paper roll support shaft includes a first support shaft and a second support shaft. The paper roll support shaft is configured to come into contact with an interior of the core at a first contact point on the first support shaft and a second contact point on the second support shaft.

According to an aspect of the present invention, a printer includes an arm part connected to a printer body part and a paper roll support shaft part having a first end connected to the arm part and a second end to be inserted into a hollow core of a paper roll. The paper roll support shaft includes two or more support shafts and an urging member configured to press an interior of the core. The two or more support shafts are configured to come into contact with the interior of the core at two or more contact points on the two or more support shafts.

DESCRIPTION OF THE EMBODIMENTS

Figure 1:
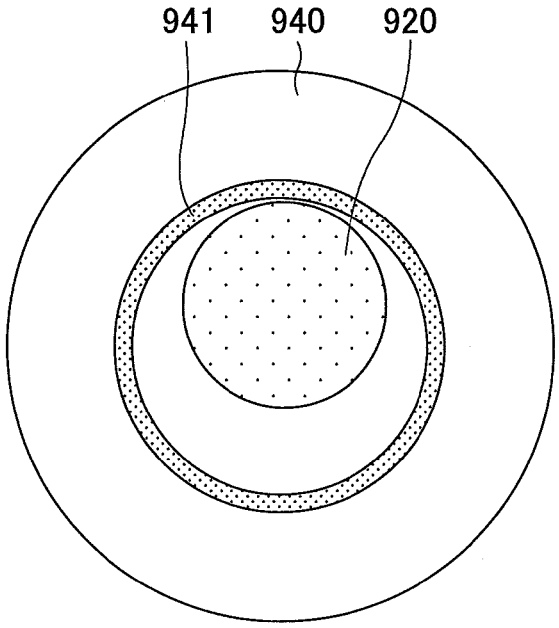
FIG.1 RELATED ART
FIG. 1 is a diagram illustrating a conventional printer.
Figure 2:
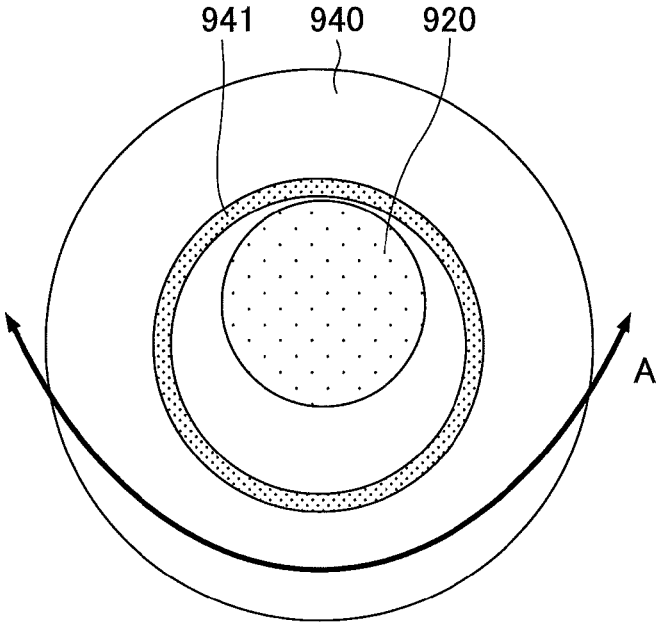
FIG.2 RELATED ART
FIG. 2 is a diagram illustrating the conventional printer.

FIG. 1 and FIG. 2 are diagrams for illustrating a conventional printer. As illustrated in FIG. 1, the diameter of a paper roll support shaft 920 is generally smaller than the inside diameter of a core 941 around which recording paper 940 is wound. Therefore, as the recording paper 940 is subjected to printing and fed, the recording paper 940 wound in a roll around the core 941 rotates. When the recording paper 940 wound in a roll rotates, the entire recording paper 940 swings greatly on the paper roll support shaft 920 as indicated by a double-headed arrow A in FIG. 2. When the entire recording paper 940 swings greatly in this manner, the position of the recording paper 940 is not determined, so that the remaining amount of the recording paper 940 may not be detected with accuracy. Furthermore, when the recording paper 940 wound in a roll swings on the paper roll support shaft 920 in a direction opposite to a direction from which the recording paper 940 is fed, the feeding of the recording paper 940 may be hindered, so that the recording paper 940 may be prevented from being smoothly fed toward the side of a thermal head (not illustrated).

According to an aspect of the present invention, a printer that prevents or reduces the swinging of a roll of recording paper on a paper roll support shaft at the time of feeding the recording paper is provided.

A description of embodiments of the present invention is given below with reference to the accompanying drawings. In the following, the same elements are referred to the same reference numerals, and their description is omitted.

First Embodiment

Figure 3:
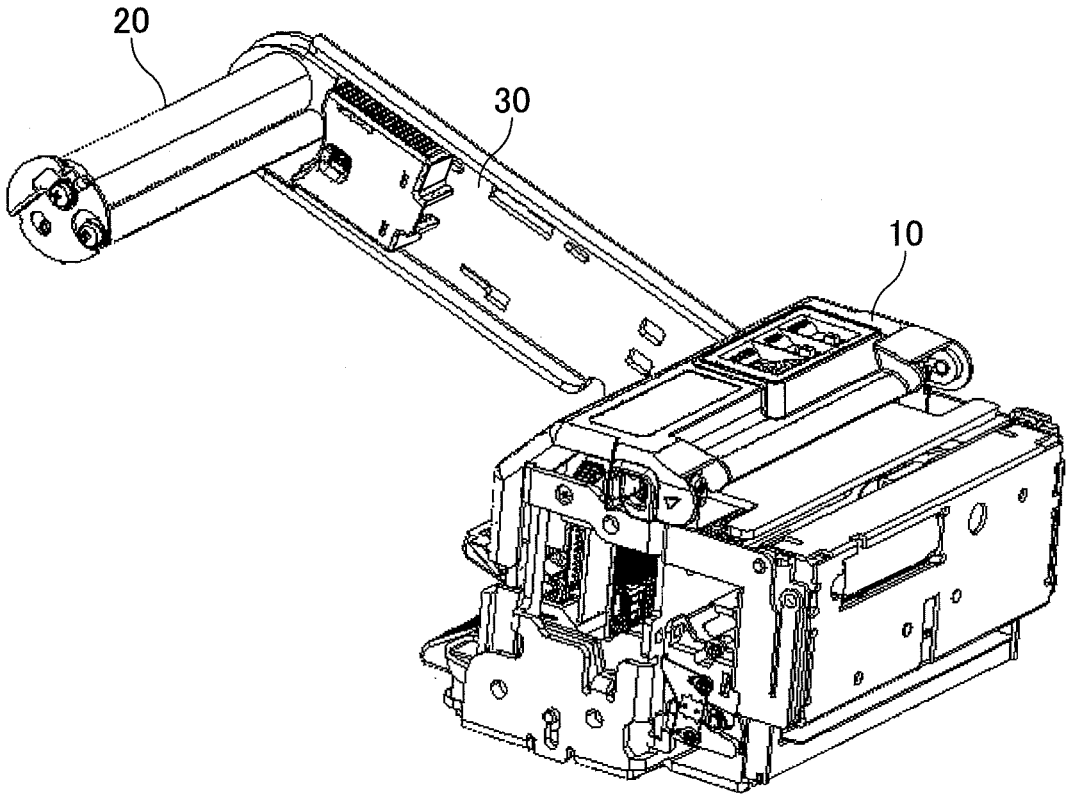
FIG. 3 is a perspective view of a printer according to a first embodiment.
Figure 4:
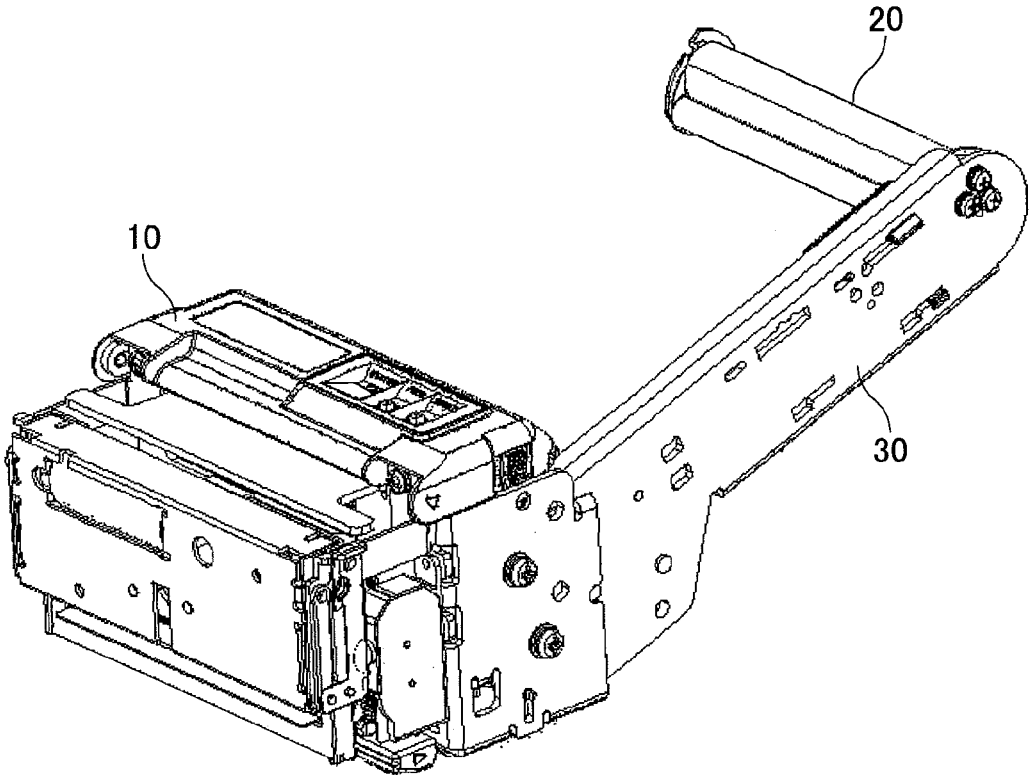
FIG. 4 is a perspective view of the printer according to the first embodiment.
Figure 5:
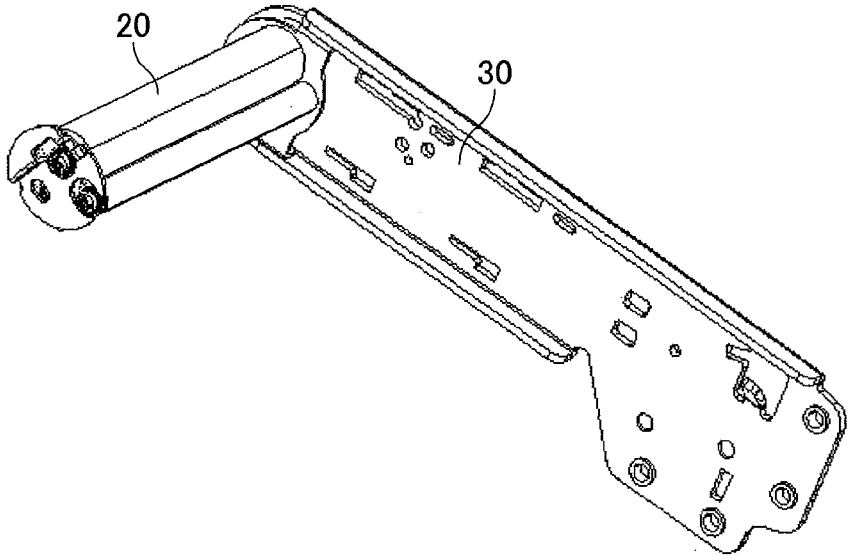
FIG. 5 is a perspective view of a paper roll support shaft part and an arm part of the printer according to the first embodiment.
Figure 6:
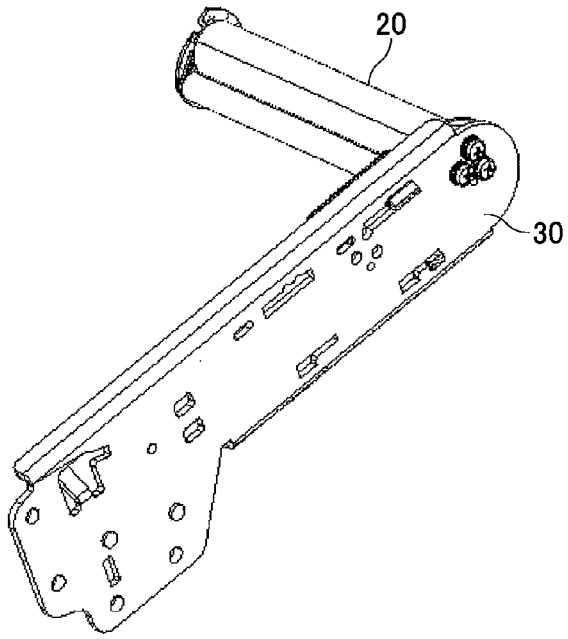
FIG. 6 is a perspective view of the paper roll support shaft part and the arm part of the printer according to the first embodiment.

Referring to FIG. 3, FIG. 4, FIG. 5 and FIG. 6, a printer according to a first embodiment includes a printer body part 10 in which printing is performed on recording paper, a paper roll support shaft part 20, and an arm part 30. The paper roll support shaft part 20 supports recording paper wound in a roll. The arm part 30 connects the printer body part 10 and the paper roll support shaft part 20. FIG. 3 is a perspective view of the printer from the printer body part 10 side. FIG. 4 is a perspective view of the printer from the arm part 30 side. FIG. 5 and FIG. 6 are perspective views illustrating a relationship between the paper roll support shaft part 20 and the arm part 30. FIG. 5 is a perspective view from the same side as FIG. 3. FIG. 6 is a perspective view from the same side as FIG. 4.

The printer body part 10, which has a so-called printer mechanism, includes a printer head such as a thermal head, a platen roller, and a motor for conveying recording paper. The paper roll support shaft part 20 has a first end connected to the arm part 30 and a second end opposite to the first end. Recording paper may be set on the paper roll support shaft part 20 by first inserting the second end of the paper roll support shaft part 20 into the core of a roll of recording paper.

Figure 7:
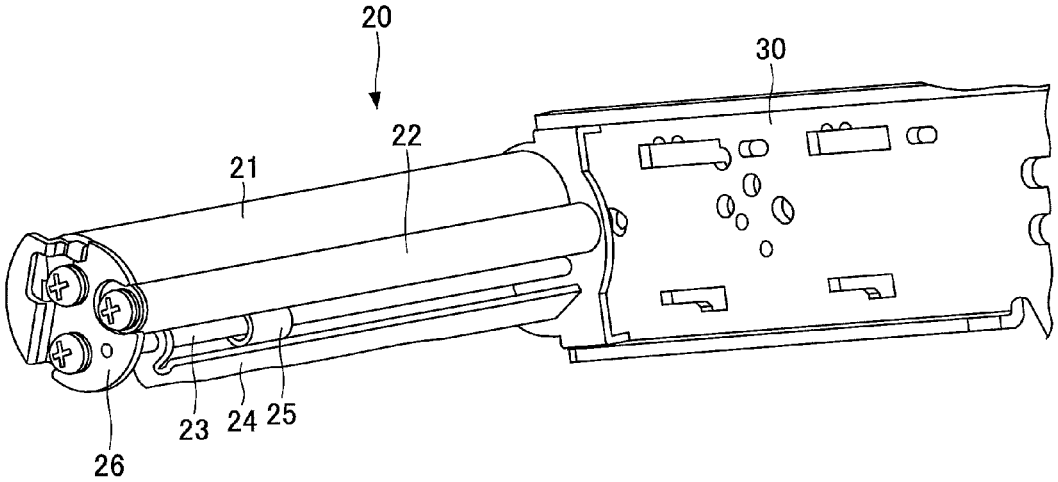
FIG. 7 is a perspective view of the paper roll support shaft part of the printer according to the first embodiment.
Figure 8:
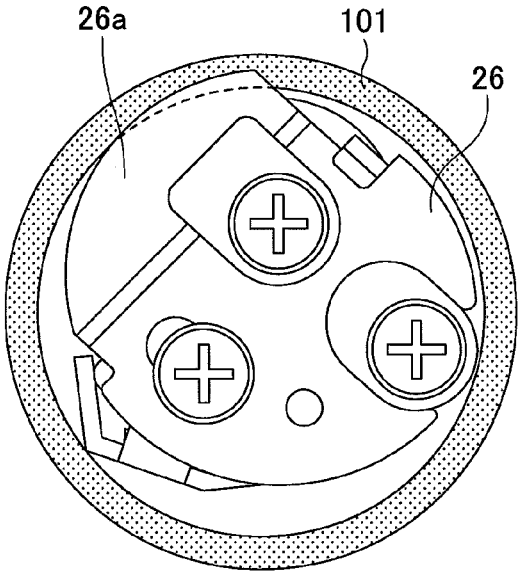
FIG. 8 is a side view of the paper roll support shaft part according to the first embodiment.
Figure 9:
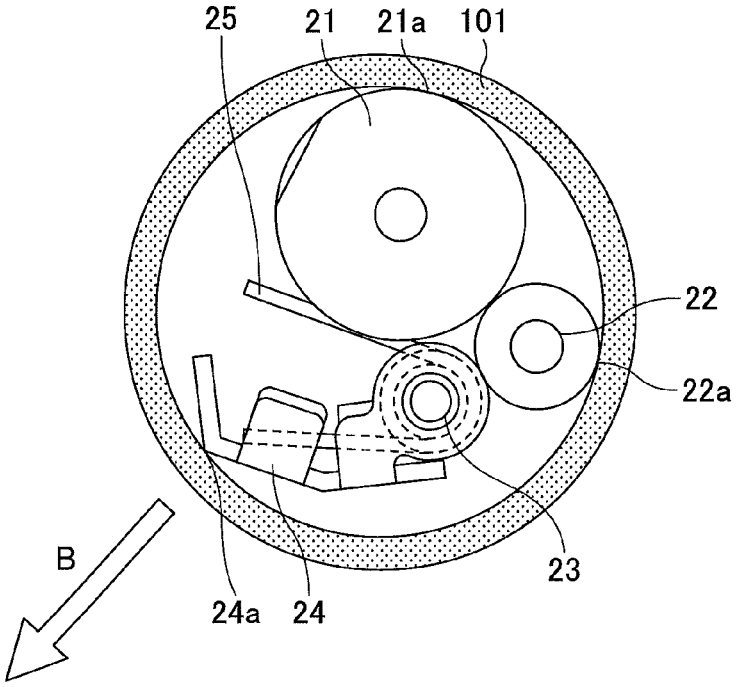
FIG. 9 is a side view of the paper roll support shaft part without a flange part according to the first embodiment.
Figure 10:
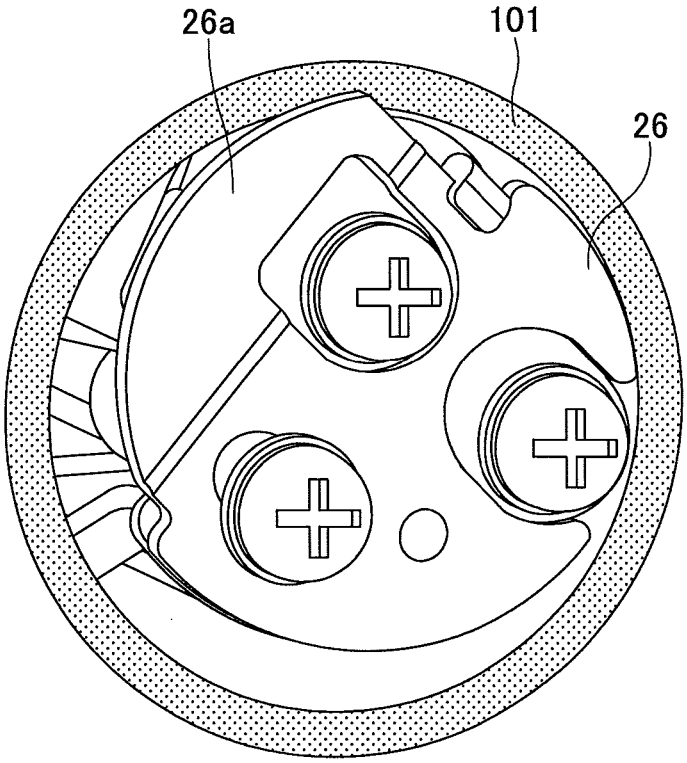
FIG. 10 is a side view of part of the paper roll support shaft part according to the first embodiment.
Figure 11:
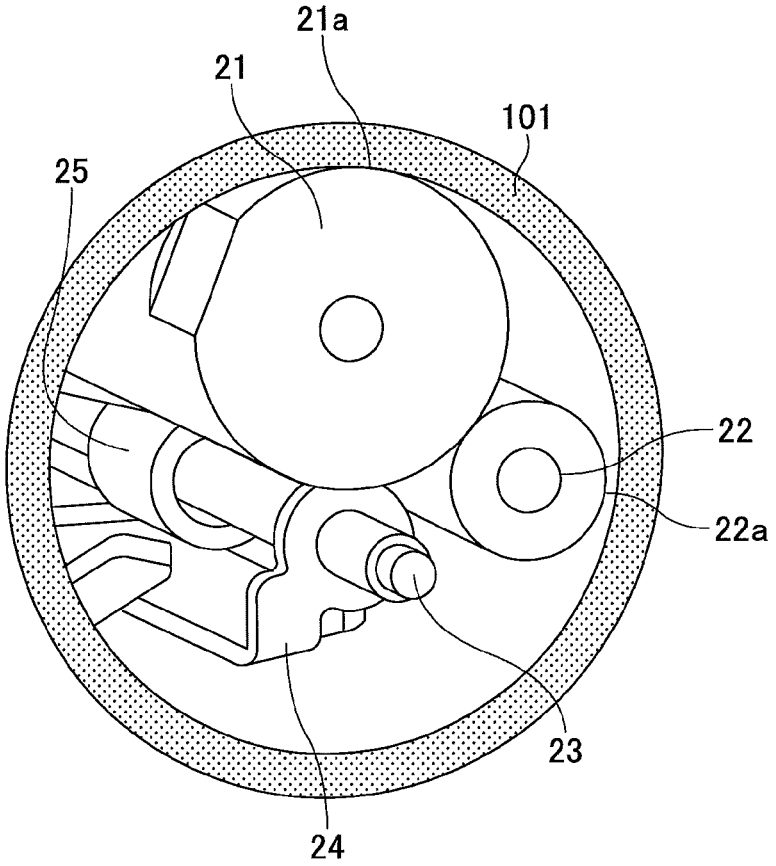
FIG. 11 is a side view of part of the paper roll support shaft part without the flange part according to the first embodiment.

FIG. 7, FIG. 8, FIG. 9, FIG. 10 and FIG. 11 illustrate the paper roll support shaft part 20. FIG. 7 is a perspective view of the paper roll support shaft part 20. FIG. 8 is a side view of the paper roll support shaft part 20. FIG. 9 is a side view of the paper roll support shaft part 20 without a flange part 26. FIG. 10 is a perspective view of part of the paper roll support shaft part 20. FIG. 11 is a perspective view of part of the paper roll support shaft part 20 without the flange part 26. Recording paper is wound in a roll around the exterior of a hollow (tubular) core 101. In FIG. 8 through FIG. 11, the core 101 alone is illustrated in order to illustrate the relationship between the paper roll support shaft part 20 and the core 101 of the recording paper.

The paper roll support shaft part 20 according to this embodiment includes a first support shaft 21, a second support shaft 22, a support shaft part 23, a depressing member 24, a spring 25, and the flange part 26.

The first support shaft 21 and the second support shaft 22 have a substantially cylindrical shape, and are substantially as long as or slightly longer than the core 101 of the recording paper. The first support shaft 21 and the second support shaft 22 may be in contact as illustrated in, for example, FIG. 9 or out of contact with each other. The diameter of the first support shaft 21 may be different from the diameter of the second support shaft 22.

The support shaft part 23 is substantially as long as the core 101 of the recording paper. The depressing member 24 is provided on the support shaft part 23 so as to be movable around the support shaft part 23. The spring 25, which may be a helical torsion spring and serves as an urging member, is provided between the depressing member 24 and the first support shaft 21. As a result, the depressing member 24 comes into contact with the interior of the core 101 of the recording paper at a contact part 24*a* of the depressing member 24. At the contact part 24*a*, the interior of the core 101 of the recording paper is pressed by the resilience of the spring 25 that works in a direction indicated by an arrow B in FIG. 9.

According to this embodiment, the first support shaft 21 and the second support shaft 22 are prevented from rotating even when the core 101 of the recording paper rotates. Accordingly, it is preferable that the surfaces of the first support shaft 21 and the second support shaft 22 have a smooth shape so as to reduce friction with the core 101.

According to the above-described configuration, the interior of the core 101 of the recording paper is in contact with the paper roll support shaft part 20 at three points. That is, the interior of the core 101 is in contact with the first support shaft 21 at a contact point 21*a*, in contact with the second support shaft 22 at a contact point 22*a*, and in contact with the depressing member 24 at its contact part 24*a*. These three points are in contact with the interior of the core 101 to hold the recording paper.

Of the three points that are in contact with the interior of the core 101, the contact part 24*a* of the depressing member 24 presses the interior of the core 101 because of the resilience of the spring 25 that works in the direction indicated by the arrow B in FIG. 9. This pressing by the contact part 24*a* makes it possible to ensure the contact of the paper roll support shaft part 20 with the interior of the core 101 at the three points. Accordingly, at the time of feeding the recording paper wound in a roll around the core 101, the core 101 of the recording paper is prevented from swinging even when the core 101 of the recording paper rotates. Therefore, it is possible to detect the remaining amount of recording paper with accuracy, and it is possible to stably feed the recording paper toward the side on which the printer body part 10 is provided.

Furthermore, as illustrated in FIG. 10, the flange part 26 is provided in the printer according to this embodiment so as to prevent the core 101 of the recording paper from coming off the paper roll support shaft part 20. The flange part 26 is provided at the second end of the paper roll support shaft part 20. The flange part 26 includes a holding portion 26*a* that projects outside the core 101 of the recording paper. As a result, the core of the recording paper is held by the arm part 30 on one side and is held by the holding portion 26*a* of the flange part 26 on the other side. Therefore, the recording paper is prevented from coming off the paper roll support shaft part 20 at the time of operations such as normal printing.

The flange part 26 as a whole has a shape smaller than the internal shape (space) of the core 101 of the recording paper so as to allow the paper roll support shaft part 20 to be inserted into the core 101 of the recording paper with the core 101 moving against the resilience of the spring 25. For example, in the side view of FIG. 8, the size of the planar shape of the flange part 26 may be smaller than the inside diameter of the core 101. By thus fitting the core 101 of the recording paper over the paper roll support shaft part 20 via the resilience of the spring 25, the core 101 of the recording paper is pressed because of the resilience of the spring 25 at the contact part

24*a* of the depressing member 24. As a result, it is possible to stably and reliably set the recording paper on the paper roll support shaft part 20.

Figure 12:
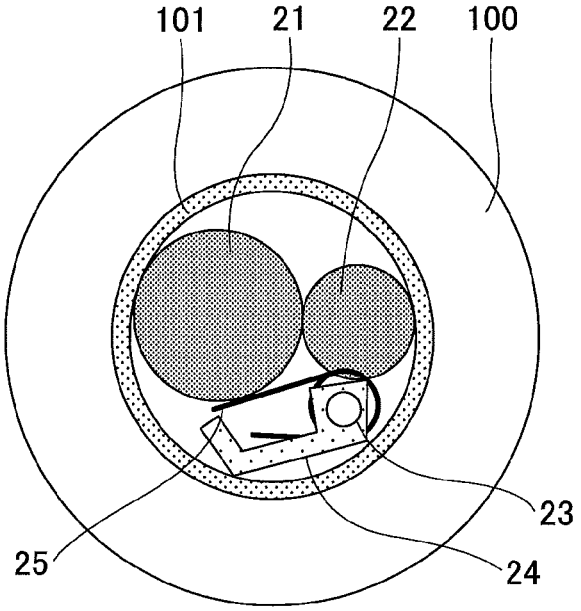
FIG. 12 is a diagram illustrating a configuration of the paper roll support shaft part according to the first embodiment.

In the above-described paper roll support shaft part 20, a helical torsion spring is used for the spring 25 and this helical torsion spring is wound around the support shaft part 23 as illustrated in FIG. 12. The kind of the spring 25 and the position at which the spring 25 is provided, however, are not limited to those described above.

Figure 13:
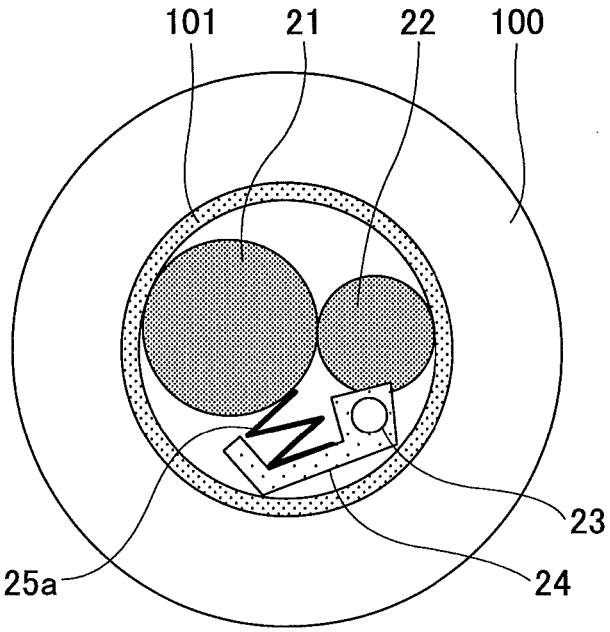
FIG. 13 is a diagram illustrating another configuration of the paper roll support shaft part according to the first embodiment.
Figure 14:
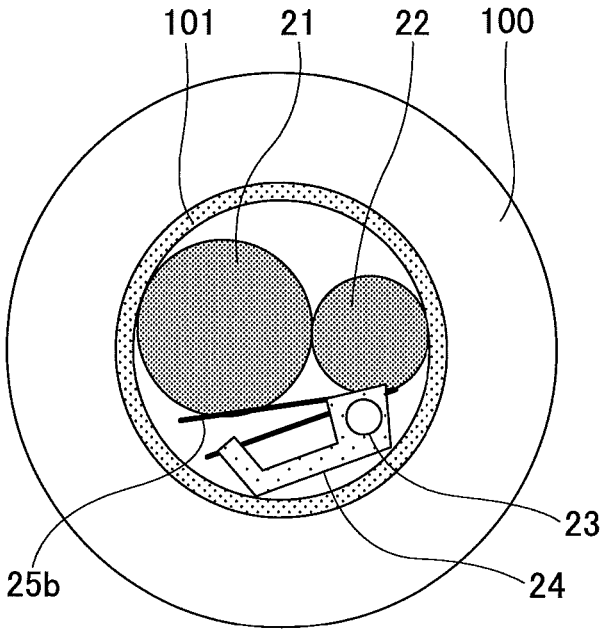
FIG. 14 is a diagram illustrating another configuration of the paper roll support shaft part according to the first embodiment.
Figure 15:
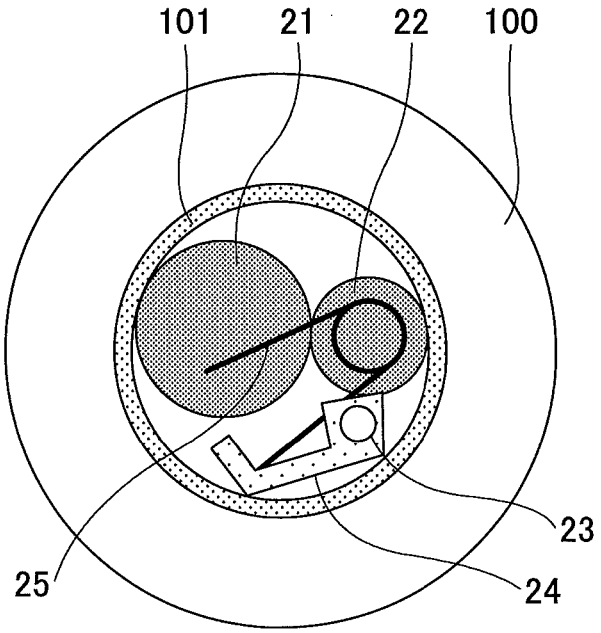
FIG. 15 is a diagram illustrating another configuration of the paper roll support shaft part according to the first embodiment.
Figure 16:
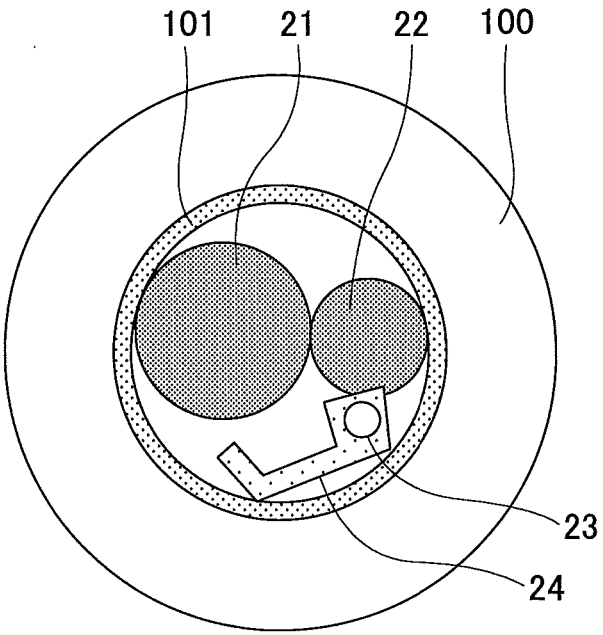
FIG. 16 is a diagram illustrating another configuration of the paper roll support shaft part according to the first embodiment.

For example, the spring 25 (helical torsion spring) may be replaced with a coil spring 25*a* as illustrated in FIG. 13, or the spring 25 (helical torsion spring) may be replaced with a leaf spring 25*b* as illustrated in FIG. 14. Alternatively, the spring 25 may be so provided as to be substantially concentric with the second support shaft 22 as illustrated in FIG. 15. Alternatively, the depressing member 24 may have an urging force to serve as an urging member without using a separate urging member such as the spring 25 as illustrated in FIG. 16.

Figure 17:
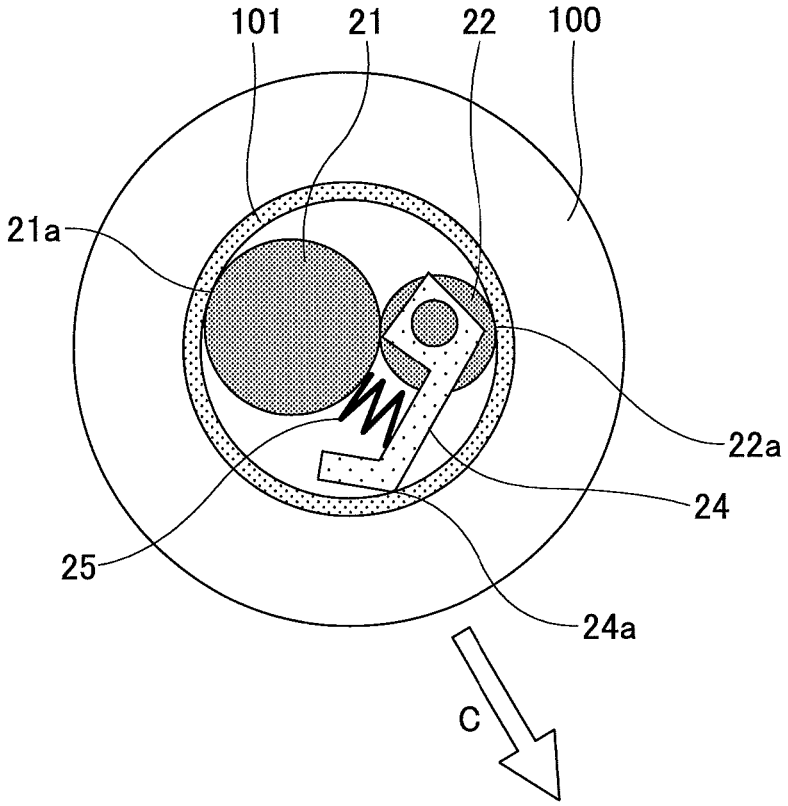
FIG. 17 is a diagram illustrating another configuration of the paper roll support shaft part according to the first embodiment.

Furthermore, according to this embodiment, the support shaft part 23 may be omitted, and the first support shaft 21 or the second support shaft 22 may be used as a rotation shaft for the depressing member 24 as illustrated in FIG. 17. For example, the depressing member 24 is rotatably attached to the second support shaft 22, and may press the interior of the core 101 of recording paper 100 at the contact part 24*a* with the resilience of the spring 25 that works in a direction indicated by an arrow C in FIG. 17. According to this configuration, it is possible to cause the paper roll support shaft part 20 to come into contact with the interior of the core 101 at three points, that is, the contact point 21*a* on the first support shaft 21, the contact point 22*a* on the second support shaft 22, and the contact part 24*a* of the depressing member 24, so that it is possible to prevent or reduce the swinging of the recording paper 100.

Figure 18:
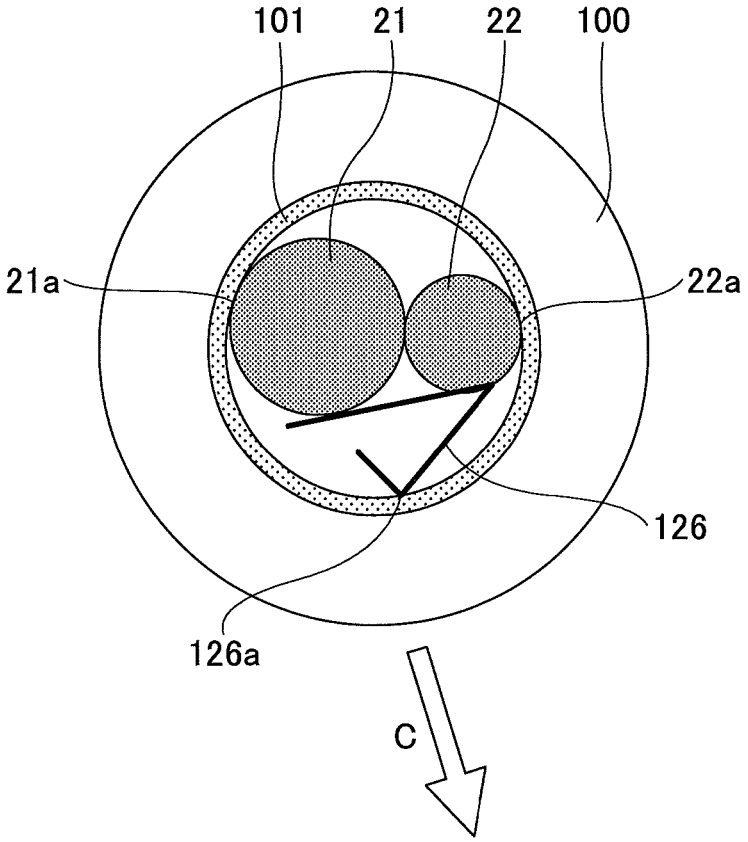
FIG. 18 is a diagram illustrating another configuration of the paper roll support shaft part according to the first embodiment.

Alternatively, the paper roll support shaft part 20 may include a leaf spring member 126 in place of the support shaft part 23, the depressing member 24, and the spring 25 as illustrated in FIG. 18. For example, the leaf spring member 126 may be provided so that the interior of the core 101 of the recording paper 100 may be pressed at a contact part 126*a* of the leaf spring member 126 with the resilience of the leaf spring member 126 that works in a direction indicated by an arrow C in FIG. 18. By thus providing the leaf spring member 126, it is possible to cause the paper roll support shaft part 20 to come into contact with the interior of the core 101 at three points, that is, the contact point 21*a* on the first support shaft 21, the contact point 22*a* on the second support shaft 22, and the contact part 126*a* of the leaf spring member 26, so that it is possible to prevent or reduce the swinging of the recording paper 100. By way of example, in the case illustrated in FIG. 18, the leaf spring member 126 is provided between the interior of the core 101 and the first and second support shafts 21 and 22.

Figure 19:
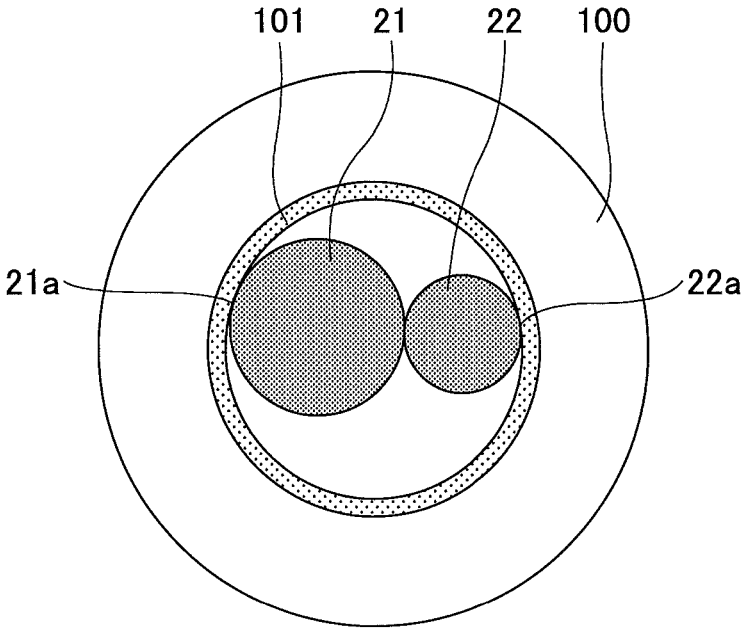
FIG. 19 is a diagram illustrating another configuration of the paper roll support shaft part according to the first embodiment.

Alternatively, in the printer according to this embodiment, the support shaft part 23, the depressing member 24, and the spring 25 may be omitted from the paper roll support shaft part 20 as illustrated in FIG. 19. For example, by providing the first support shaft 21 and the second support shaft 22, it is possible to cause the paper roll support shaft part 20 to come into contact with the core 101 of the recording paper 100 at two points, that is, the contact point 21*a* on the first support shaft 21 and the contact point 22*a* on the second support shaft 22. According to this configuration, compared with the case of a single support shaft, it is possible to prevent or reduce the swinging of the recording paper 100 due to the rotation of the recording paper 100 at the time of the feeding of the recording paper 100. According to this configuration, it is preferable that the first support shaft 21 and the second support shaft 22 be formed so that the sum of the diameter of the first support shaft 21 and the diameter of the second support shaft 22 is slightly smaller than the inside diameter of the core 101 of the recording paper 100. By thus forming the first support shaft 21 and the second support shaft 22, it is possible to reduce the degree of swinging of the recording paper 100 at the time when the recording paper 100 rotates.

Second Embodiment

Next, a description is given of a second embodiment. A printer according to this embodiment includes a paper roll support shaft part that has a structure different from the structure of the paper roll support shaft part 20 of the printer according to the first embodiment.

Figure 20:
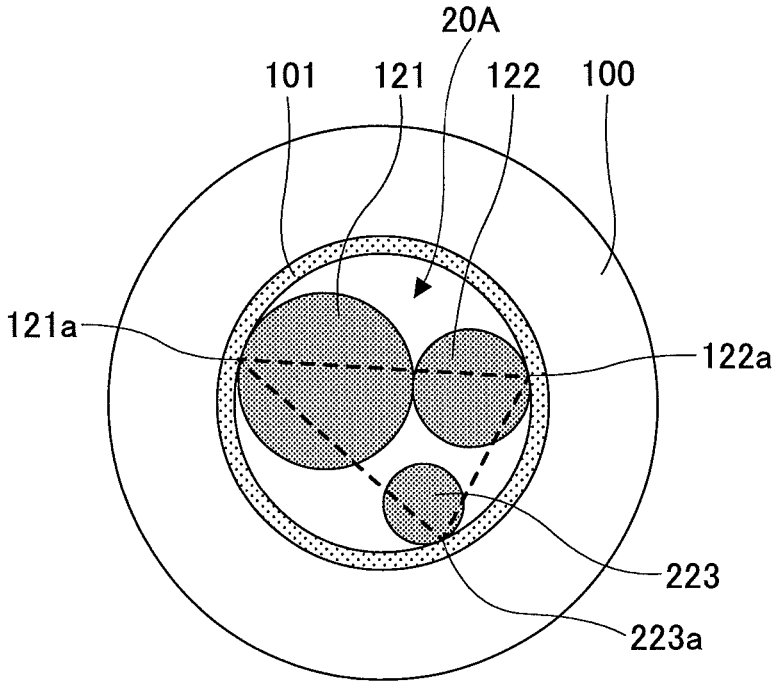
FIG. 20 is a diagram illustrating a configuration of a paper roll support shaft part according to a second embodiment.

Referring to FIG. 20, the printer according to this embodiment includes a paper roll support shaft part 20A that includes a first support shaft 121 having a substantially columnar shape, a second support shaft 122 having a substantially columnar shape, and a third support shaft 223 having a substantially columnar shape. By thus providing the first support shaft 121, the second support shaft 122, and the third support shaft 223, it is possible to cause the paper roll support shaft part 20A to come into contact with the interior of the core 101 at three points, that is, a contact point 121*a* on the first support shaft 121, a contact point 122*a* on the second support shaft 122, and a contact point 223*a* on the third support shaft 223 as indicated by a broken line in FIG. 20. According to this configuration, it is possible to prevent or reduce the swinging of the recording paper 100.

Figure 21:
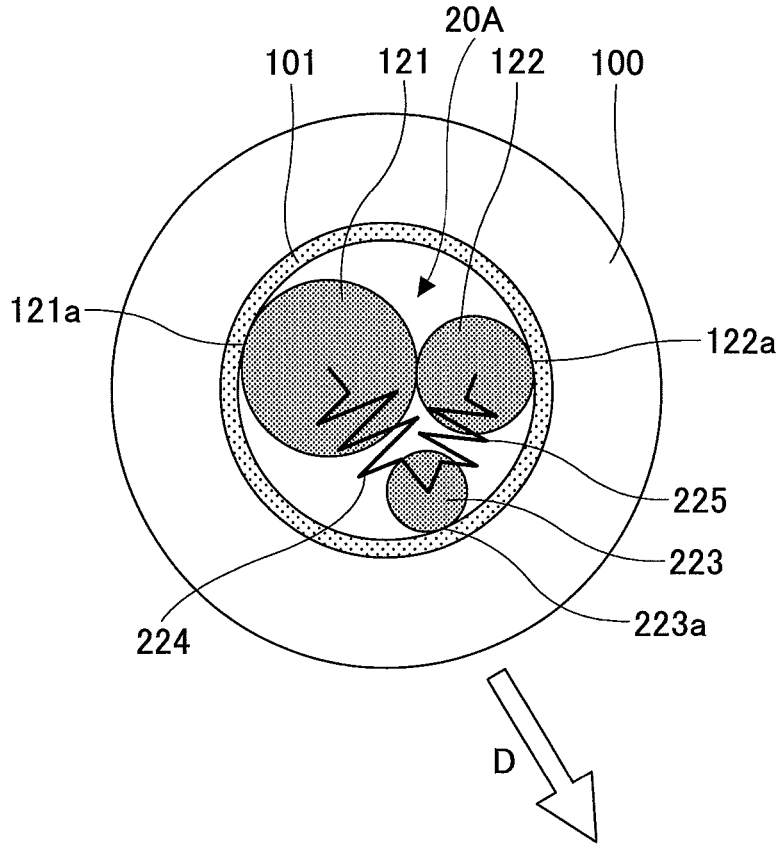
FIG. 21 is a diagram illustrating another configuration of the paper roll support shaft part according to the second embodiment.

According to this embodiment, the paper roll support shaft part 20A may further include coil springs 224 and 225 as illustrated in FIG. 21. For example, the coil spring 224, which has such resilience as to widen the gap between the first support shaft 121 and the third support shaft 223, may be provided between the first support shaft 121 and the third support shaft 223, and the coil spring 225, which has such resilience as to widen the gap between the second support shaft 122 and the third support shaft 223, may be provided between the second support shaft 122 and the third support shaft 223. By thus providing the coil springs 224 and 225, a resilience works in a direction indicated by an arrow D in FIG. 21, so that the interior of the core 101 of the recording paper 100 is pressed. Therefore, it is possible to ensure the contact of the interior of the core 101 of the recording paper 100 with the first support shaft 121, the second support shaft 122, and the third support shaft 223.

Figure 22:
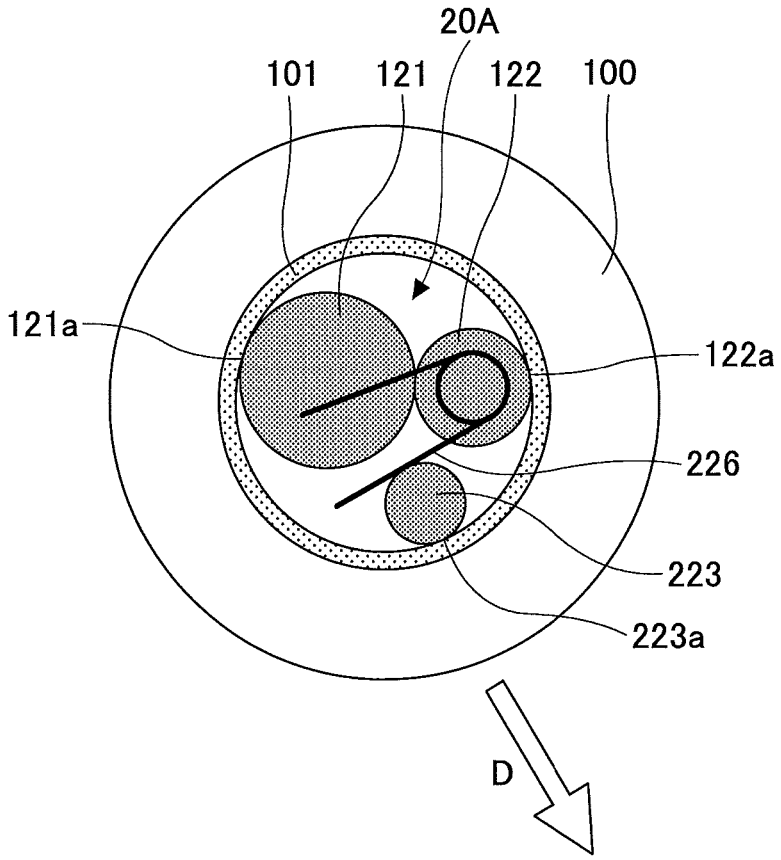
FIG. 22 is a diagram illustrating another configuration of the paper roll support shaft part according to the second embodiment.
Figure 23:
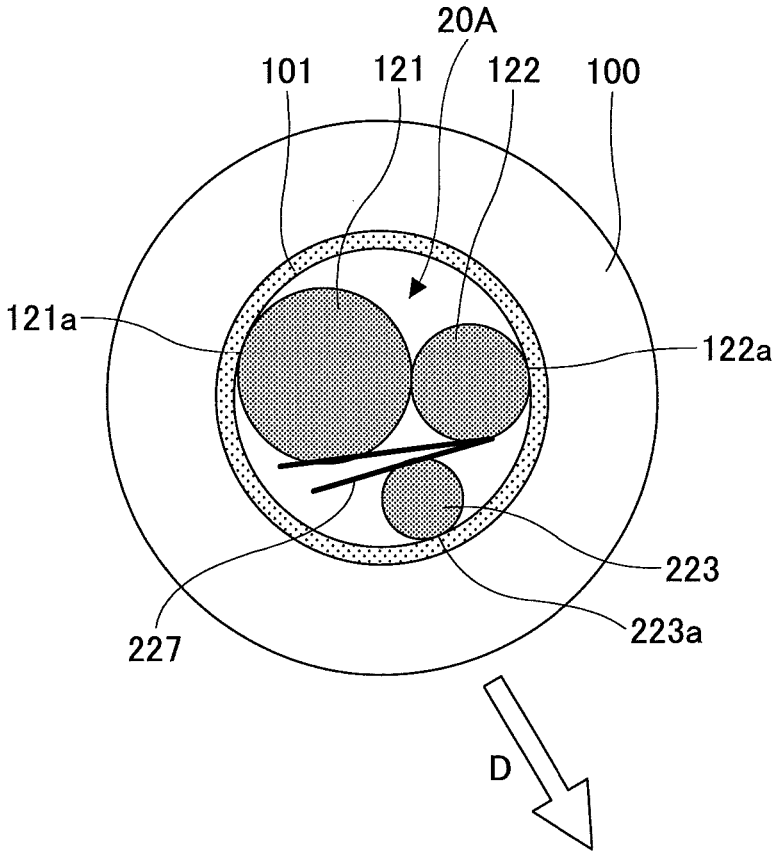
FIG. 23 is a diagram illustrating another configuration of the paper roll support shaft part according to the second embodiment.

Alternatively, the coil springs 224 and 225 may be replaced with a helical torsion spring 226 as illustrated in FIG. 22, or the coil springs 224 and 225 may be replaced with a torsion leaf spring 227 as illustrated in FIG. 23. According to these structures as well, a resilience works in the direction indicated by the arrow D to press the interior of the core 101 of the recording paper 100 the same as in the structure as illustrated in FIG. 21. Accordingly, the same effect as produced by the structure illustrated in FIG. 21 may be produced.

The second embodiment may be the same as the first embodiment except for the configuration as described above.

Third Embodiment

Figure 24:
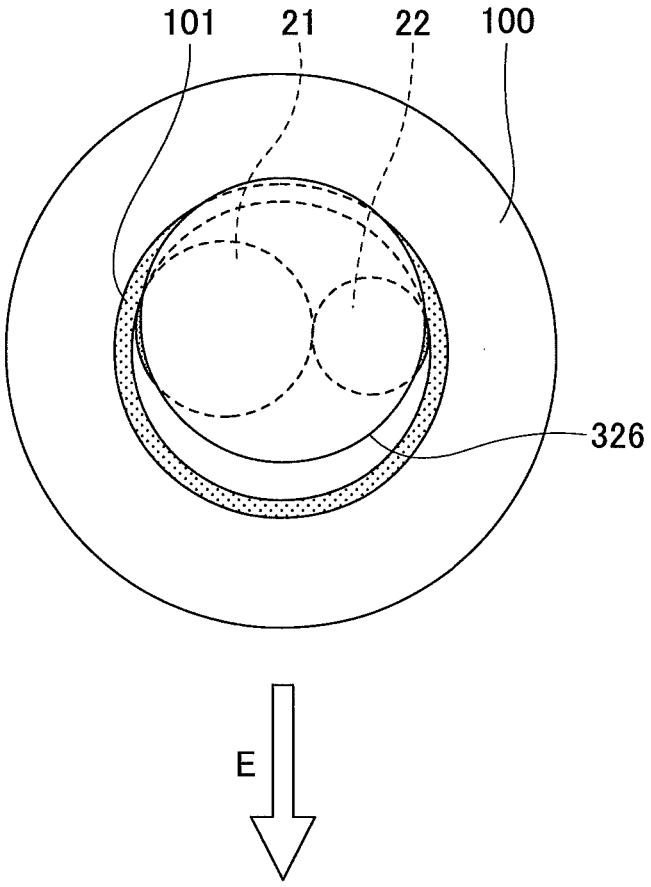
FIG. 24 is a diagram illustrating a configuration of a paper roll support shaft part according to a third embodiment.

Next, a description is given of a third embodiment. According to a printer of this embodiment, as illustrated in FIG. 24, a flange part 326 is so attached as to be positioned relatively on the upper side in the paper roll support shaft part structure illustrated in FIG. 19, where the depressing member 24 is omitted. As a result, after the insertion of a paper roll support shaft 320 (FIGS. 25A and 25B) into the core 101 of the recording paper 100, the recording paper 100 falls down because of gravity that works in a direction indicated by an arrow E in FIG. 24. Therefore, it is possible to hold a side face (end face) of the core 101 of the recording paper 100 with the flange part 326.

Figure 25A:
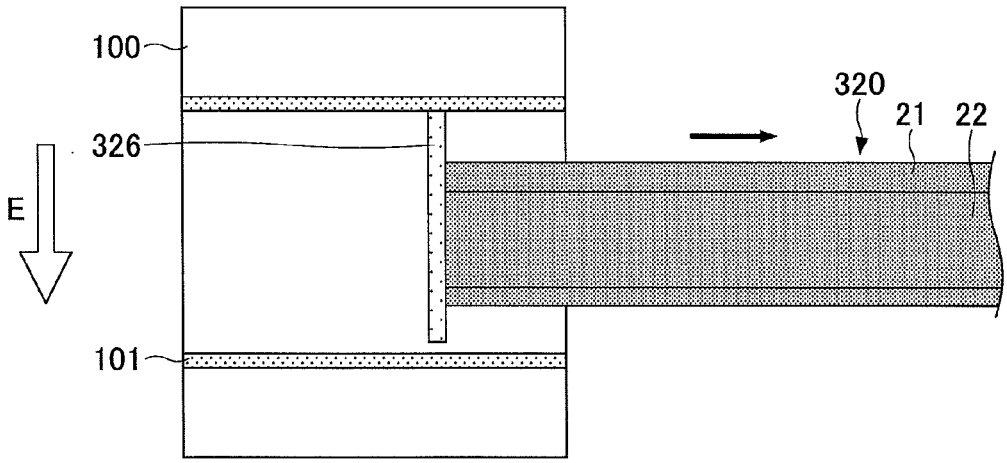
FIGS. 25A and 25B are diagrams illustrating a method of setting recording paper on the paper roll support shaft part according to the third embodiment.
Figure 25B:
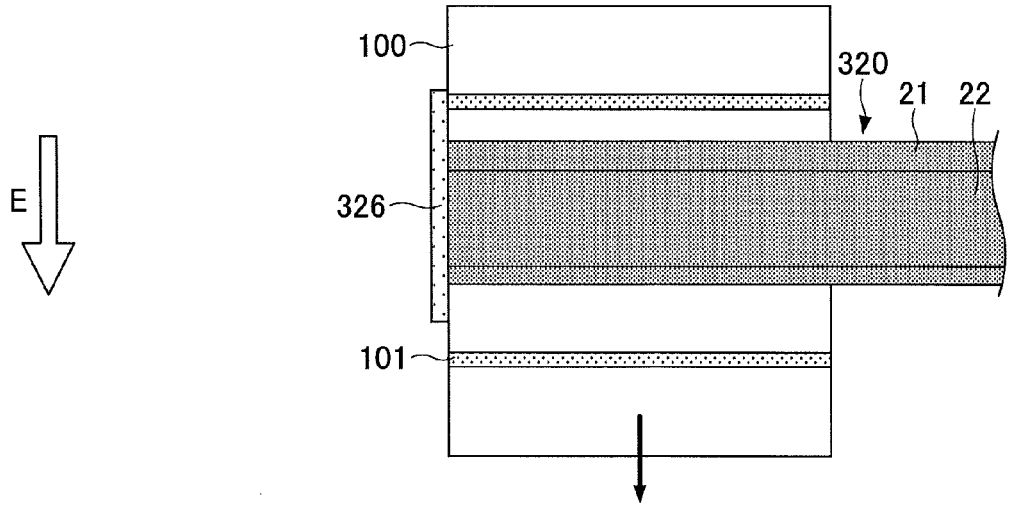

For example, referring to FIG. 25A, a first end of the paper roll support shaft part 320 is connected to an arm part (not illustrated) and the flange part 326 is provided at a second end of the paper roll support shaft part 320. The flange part 326 is attached to be offset upward relative to the center of the paper roll support shaft part 320, and the second end of the paper roll support shaft part 320 is inserted first into the core 101 of the recording paper 100. Thereafter, when the entire core 101 of the recording paper 100 has moved inside the flange part 326, the entire recording paper 100 falls down because of gravity that works in the direction indicated by the arrow E, so that the upper side of the interior of the core 101 of the recording paper 100 comes into contact with the paper roll support shaft part 320. In this state, the core 101 of the recording paper 100 is held by the arm part on one side and is held by the flange part 326 on the other side. Accordingly, the recording paper 100 is prevented from coming off the paper roll support shaft part 320.

Fourth Embodiment

Next, a description is given of a fourth embodiment. A printer according to this embodiment includes a paper roll support shaft part that has a structure different from the structure of the paper roll support shaft part 20 of the printer according to the first embodiment.

Figure 26:
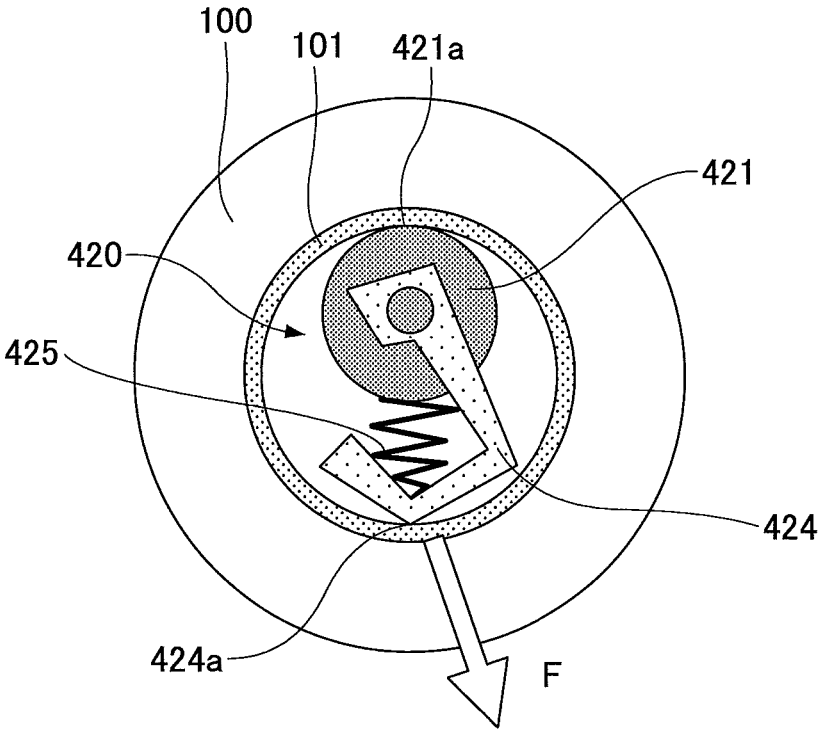
FIG. 26 is a diagram illustrating a configuration of a paper roll support shaft part according to a fourth embodiment.

Referring to FIG. 26, the printer according to this embodiment includes a paper roll support shaft part 420 that includes a single support shaft 421 having a substantially columnar shape, a depressing member 424, and a coil spring 425.

The depressing member 424 is provided on the support shaft 421 so as to be movable around the support shaft 421. The coil spring 425, which serves as an urging member, is provided between the depressing member 424 and the support shaft 421. As a result, the depressing member 424 comes into contact with the interior of the core 101 of the recording paper at a contact part 424*a* of the depressing member 424. At the contact part 424*a*, the interior of the core 101 of the recording paper is pressed by the resilience of the coil spring 425 that works in a direction indicated by an arrow F in FIG. 26.

The interior of the core 101 of the recording paper is in contact with the paper roll support shaft part 420 at two points. That is, the interior of the core 101 is in contact with the support shaft 421 at a contact point 421*a* and in contact with the depressing member 424 at its contact part 424*a*. These two points are in contact with the interior of the core 101 to hold the recording paper.

According to this configuration as well, it is possible to prevent or reduce the swinging of the recording paper 100 due to the rotation of the recording paper 100 at the time of the feeding of the recording paper 100.

The fourth embodiment may be the same as the first embodiment except for the configuration as described above.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

an arm part connected to a printer body part; and a paper roll support shaft part having a first end connected to the arm part and a second end to be inserted into a hollow core of a paper roll, wherein the paper roll support shaft includes a first support shaft and a second support shaft each of which is configured to come into contact with an interior of the core; and an urging member configured to press the interior of the core and to press at least the first support shaft toward the interior of the core.

2. The printer as claimed in claim 1, wherein the paper roll support shaft part further includes a third support shaft configured to come into contact with the interior of the core.

3. The printer as claimed in claim 1, wherein the paper roll support shaft part further includes a depressing member configured to come into contact with the interior of the core, wherein the urging member is configured to press the interior of the core via the depressing member.

4. The printer as claimed in claim 3, wherein the urging member is one of a helical torsion spring, a coil spring, and a leaf spring.

5. The printer as claimed in claim 1, wherein the paper roll support shaft part further includes a flange part at the second end, the flange part having a shape smaller than an internal shape of the core, so that a first side of the core is held by the arm part and a second side of the core is held by the flange part with the paper roll support shaft part being inserted in the core.

6. A printer, comprising:

an arm part connected to a printer body part; and a paper roll support shaft part having a first end connected to the arm part and a second end to be inserted into a hollow core of a paper roll, wherein the paper roll support shaft includes a support shaft configured to come into contact with an interior of the core, a depressing member provided on the support shaft so as to be movable around the support shaft, and an urging member that urges the depressing member so as to press the depressing member toward the interior of the core.

* * * * *